United States Patent [19]

Arnold

[11] Patent Number: 4,798,327

[45] Date of Patent: Jan. 17, 1989

[54] CONVECTION LOCK-VENT

[76] Inventor: George R. Arnold, 5 Hope Dr., Sutherland, Va. 24594

[21] Appl. No.: 696,033

[22] Filed: Jan. 29, 1985

[51] Int. Cl.[4] ..... F24D 5/00

[52] U.S. Cl. ..... 237/50; 98/42.01

[58] Field of Search ..... 98/42.02, 42.01, 39.1, 98/87, 33 R, 42.17, 42.19, 42.16, 31.5; 237/50, 46

[56] References Cited

U.S. PATENT DOCUMENTS

| | | | |
|---|---|---|---|
| 353,111 | 11/1886 | Bailey | 237/50 |
| 2,635,524 | 4/1953 | Jenkins | 98/31.5 |
| 4,326,453 | 4/1982 | La Boda et al. | 98/39.1 |

*Primary Examiner*—Henry A. Bennet

*Attorney, Agent, or Firm*—Kenyon & Kenyon

[57] ABSTRACT

A device for the redistribution of warm air within a building is provided. A device comprises a warm air collecting means which effectively collects warm air to be redistributed throughout the building and which can be disabled in an asthetically pleasing manner.

4 Claims, 2 Drawing Sheets

CONVECTION LOCK-VENT

FIELD OF THE INVENTION

This invention relates generally to devices for the re-distribution of warm air within buildings.

BACKGROUND OF THE INVENTION

It has become increasingly popular in recent years to use supplemental heating devices in buildings. For example, wood-burning stoves, fireplaces, propane heaters and kerosene heaters are often used to provide heating in many homes or places of businesses. Typically, these supplemental heating devices are not part of the building's central heating system and they are usually located in only one room of the building. This gives rise to a substantial drawback which is often associated with tehse supplemental heating systems. Namely, the warm air generated by these systems is poorly distributed throughout the building. In fact, the warmed air can be confined to a very small area, often only one room of the building. Thus, some rooms are left uncomfortably cold, while others are unpleasantly over-heated. This poor utilization of the heat generated by supplemental heating units makes supplementary heating devices less attractive and uneconomical.

This poor utilization is due, in large part, to the inability of the warmed air to redistribute itself throughout the building. Natural convection currents are ill-suited to move warm air first, laterally through a building, and then upwards to higher floors through available pathways, such as stairwells. Further, there is seldom any provision made for mechanical redistribution of the air which is warmed by the supplemental heating device and the ductwork, if any, of the central heating system is poorly adapted to collect and redistribute heat which is generated anywhere other than the central furnace.

The problem of poor distribution of heated air within a building also occurs in situations other than those involving supplemental heating devices. For example, a building with a poorly balanced central heating system or a building to which an addition has been made may face this problem.

Any permanent system or device for the redistribution of warmed air through a building should be functional during cold weather and yet be capable of being disabled during warmer weather when its operation would be unnecessary or even undesirable. This should be accomplished by as rapid and simple a means as possible.

Finally, any such device must have a pleasing appearance and be unobtrusive. These considerations are especially important in homes.

SUMMARY OF THE INVENTION

Accordingly, a device has been developed which provides for redistribution of warmed air from a warm area of a building to a colder area of the building. This device makes use of natural convection currents to effect this redistribution. When operation of the device is either unnecessary or undesirable, it can be quickly and easily disabled.

Devices according to the present invention have a warm air collecting means which extends downward from the ceiling of a room in the warm part of the building. The warm air collecting means is connected to a conduit means through which the warm air may flow. The conduit means opens into the cold area of the building and is positioned so as to provide a flow path for the warmed air which is compatible with natural convection currents. This arrangement makes the use of mechanical assist devices such as fans, unnecessary and results in an exceptional degree of efficiency.

The warm air collecting means should be located so as to be near any supplemental heat source and should be oriented so that its opening faces the heat source. The shape of the warm air collecting means may be adapted to permit optimal collection of warm air. For example, it may be arranged in a circle or semi-circle about the heat source. However, for ease and economy of construction, a linear arrangement is most favored.

BRIEF DESCRIPTION OF THE DRAWINGS

FIG. 3-B is a cross-sectional representation of a device according to the claimed invention in a closed configuration.

FIG. 4-B is a cross-sectional representation of a device according to the present invention in a closed configuration.

Turning now to FIG. 1 a warm air collecting means 10 which may be used in this invention is shown in cross-section. The collecting means 10 has a downwardly sloping lower face 11, an upper face 12 and sides 13 and 14. Opening 15 is found between lower face 11 and side 14 and is oriented toward a heat source or a region of warmed air.

FIG. 2 shows an embodiment of the present invention in a longitudinal perspective. In this view the warm air collecting means 10 is shown including side 14 and opening 15. The warm air collecting means 10 is partially within the ceiling of the room in which it is located and is connected to conduit means 16 which directs the warm air which enters the device at opening 15 towards a part of the building which has colder air. A cover means 17 can be affixed to the opening of the conduit means 16 at its end which is oposite the warm air collecting means 10. Cover means 17 is typically a grill-work and must permit the free flow of air through the conduit means.

In FIGS. 3-A and 3-B certain aspects of a particularly advantageous embodiment of the claimed invention are illustrated. These Figures show a modifed warm air collecting means 20 in cross section. In this embodiment, the warm collecting means 20 has a lower face 21 which is shown sloping downwardly in FIG. 3-A. The warm air collecting means 20 also has an upper face 22 and sides 23 and 24. The lower face 21 is connected to side 23 by a pivoting means 26 (e.g., a hinge). The lower face 21 can rotate about the pivoting means 26 so that it slopes downwardly as in FIG. 3-A or so that it comes into contact with side 24, thereby closing space 25, as shown in FIG. 3-B. The upward rotation of the lower face 21 is advantageously limited by a catch lip 27 which engages the edge of side 24. The warm air collecting means 20 is also joined to end walls 29 which have catch lips 28 which limit the downward rotation of the lower face 21 and help direct warm air into the warm air collecting means 20. The lower face 21 can be held in the position shown in FIG. 3-B by a deadbolt, a magnetic catch or other such locking means.

Figure 1:
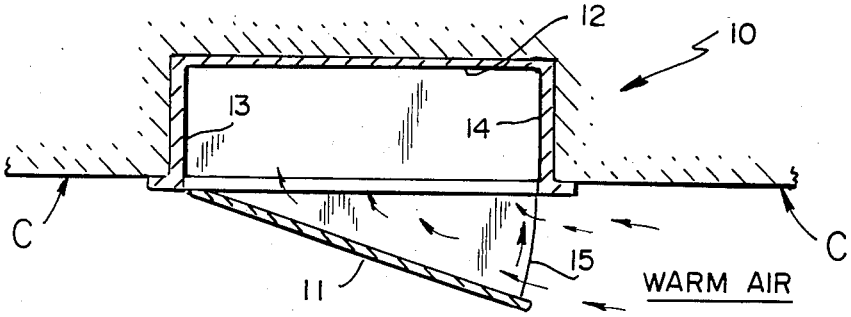
FIG. 1 is a cross-sectional view of a device according to the present invention.
Figure 2:
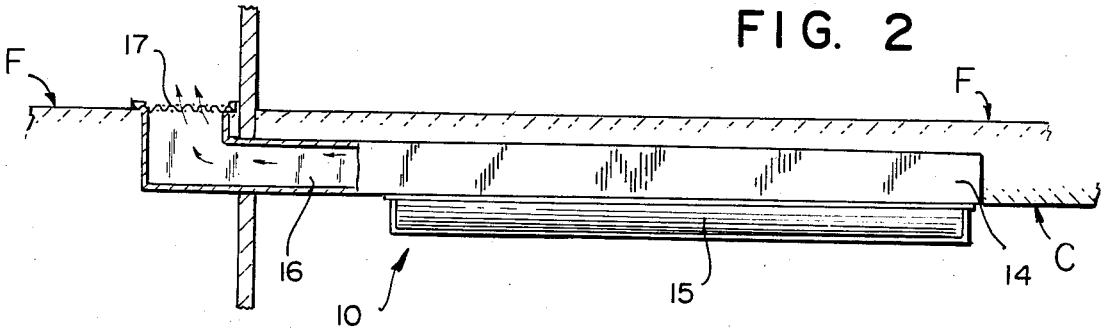
FIG. 2 is a longitudinal view of a device according to the present invention.
Figure 3A:
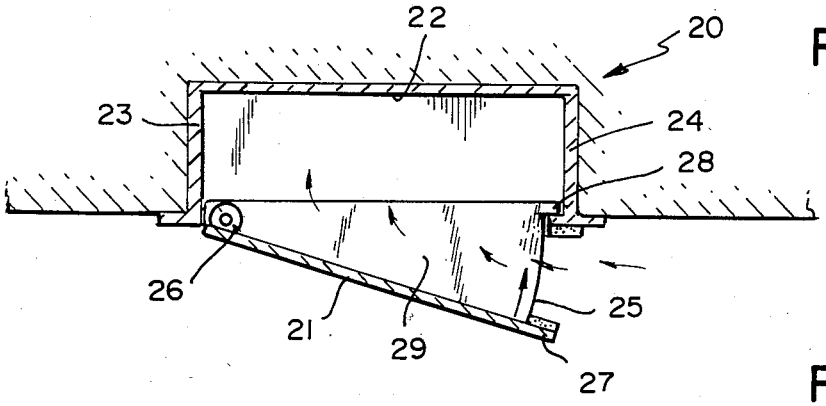
FIG. 3-A is a cross-sectional representation of a preferred embodiment of the claimed invention in an open configuration.
Figure 3B:
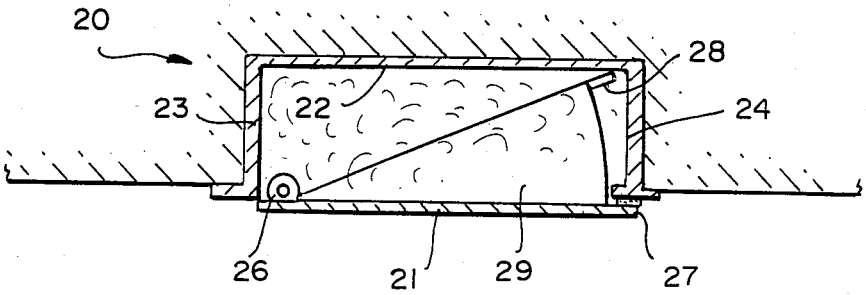

The embodiment of the warm air collecting means shown in FIGS. 3-A and 3-B has several advantages. For example, it may be closed when the off-season weather does not require the use of warm air re-distribution device. This prevents undesirable heating effects which may result under some conditions when the device is operated at times when it is not needed. This also eliminates the slightly obtrusive appearance of the lower face which extends downwardly from the ceiling.

Figure 4A:
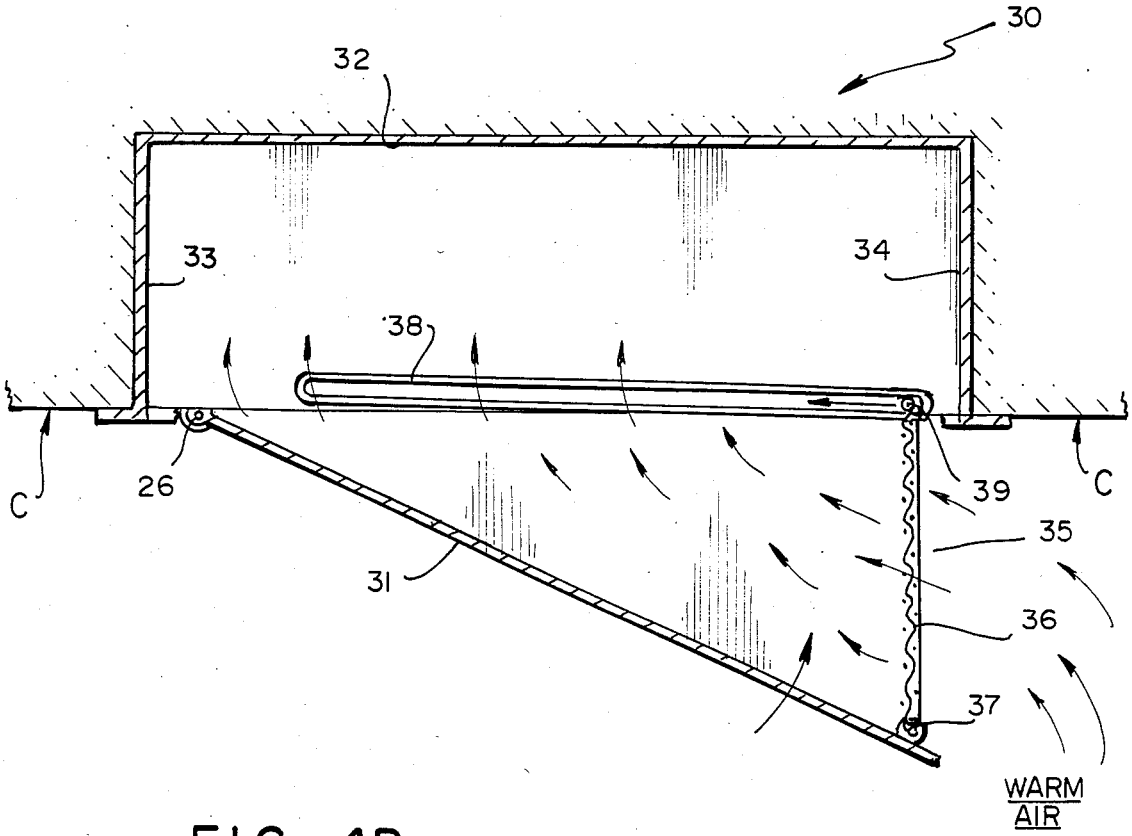
FIG. 4-A is a cross-sectional representation of a device according to the present invention in an open configuration.
Figure 4B:
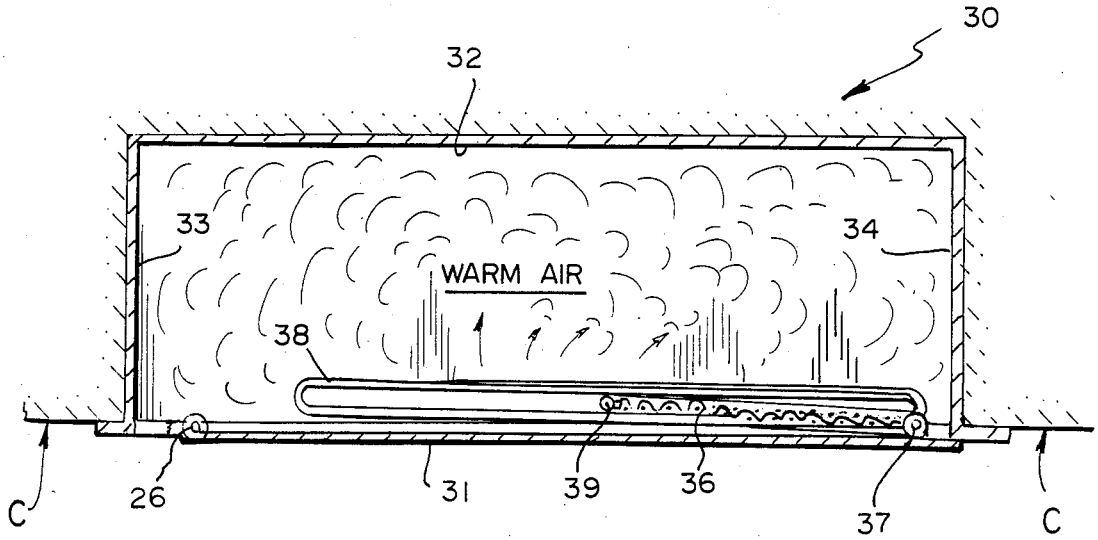

Yet another favorable embodiment of the warm air collecting means which is part of the warm air re-distribution device of this invention is shown in FIGS. 4-A and 4-B. In this embodiment, warm air collecting means 30 is shown in cross sections. The warm air collecting means 30 has a lower face 31, an upper face 32 and side faces 33 and 34. The lower face 31 is connected to side 33 by a pivoting means 26 and rotates about pivoting means 26 that it slopes downwardly, as in FIG. 4-A, or so that it comes into contact with side 34, as in FIG. 4-B. When the lower face 31 is rotated to the position shown in FIG. 4-A, a space 35 is opened between the lower face 31 and the side face 34. Warmed air enters the warmed air collecting means through this opening 35. A grill 36, which permits the free movement of air is placed across opening 35 and is joined to lower face 31 by a pivoting means 37. Slide tracks 38 are also provided between the lower edges of sides 33 and 34. The slide tracks 38 engage slide 39 on the grill 36 and secure the grill 36 to slide track 38. When the lower face 31 is rotated upwardly, the grill 36 folds back as the slides 39 move along the slide tracks 38.

This embodiment presents an additional advantage over those previously mentioned in that, when closed, the warm air collecting means can be very shallow. This is an important consideration when the available depth within a ceiling is limited.

What is claimed is:

1. A device for the redistribution of warm air across levels of a building having a higher level and a lower level comprising:

(1) a warm air collecting means located in a warm portion of a buliding, said warm portion being located in the lower levels of said building;

(2) conduit means connected to said warm air connecting means and extending into a cool portion of the building said cool portion being located in the higher portion of said building;

wherein said warm air collecting means comprises a ceiling portion which is located within the ceiling of the warm portion of the building and a protruding portion which is connected to the ceiling portion and which extends downwardly from the ceiling of the warm portion of the building, said protruding portion having an opening for the entrance of warm air from the warm portion of the building into the warm air collecting means, said opening oriented toward a heat source within the warm portion of the building and wherein said warm air is moved through said warm air collecting means and said conduit means by convection current, and wherein the protruding portion of said warm air collecting means is pivotably connected to the ceiling portion of said warm air connecting means so that the protruding portion of the warm air collection means may be rotated upwardly into the ceiling portion of the warm air collecting means, thereby disabling the device.

2. A device for the redistribution of warm air across levels of a building having a higher level and a lower level comprising:

(1) a warm air collecting means located in a warm portion of a building, said warm portion being located in the lower levels of said building;

(2) conduit means connected to said warm air connecting means and extending into a cool portion of the building said cool portion being located in the higher portion of said building;

wherein said warm air collecting means comprises a ceiling portion which is located within the ceiling of the warm portion of the building and a protruding portion which is connected to the ceiling portion and which extends downwardly from the ceiling of the warm portion of the building, said protruding portion having an opening for the entrance of warm air from the warm portion of the building into the warm air collecting means, said opening oriented toward a heat source within the warm portion of the building and wherein said warm air is moved through said warm air collecting means and said conduit means by convection current, and wherein the protruding portion of said warm air collecting means is collapsably attached to the ceiling portion of the warm air collecting means so that the protruding portion of the warm air collecting means may be collapsed in to the ceiling portion of the warm air collecting means, thereby disabling the device.

3. The device of claim 1 further comprising locking means for retaining the protruding portion of the warm air collecting means an upwardly rotated position and wherein said warm air collecting means is not operable when the protruding portion of the warm air collecting means is locked in the upwardly rotated position.

4. The device of claim 2 further comprising a locking said protruding portion in the collapsed position.

* * * * *